US008844637B2

(12) United States Patent
Baihly et al.

(10) Patent No.: US 8,844,637 B2
(45) Date of Patent: Sep. 30, 2014

(54) TREATMENT SYSTEM FOR MULTIPLE ZONES

(75) Inventors: Jason Baihly, Katy, TX (US); Don Aldridge, Manvel, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 323 days.

(21) Appl. No.: 13/348,522

(22) Filed: Jan. 11, 2012

(65) Prior Publication Data

US 2013/0175033 A1 Jul. 11, 2013

(51) Int. Cl.
*E21B 43/14* (2006.01)

(52) U.S. Cl.
USPC ..... 166/386; 166/306; 166/332.4

(58) Field of Classification Search
CPC ..... E21B 34/14; E21B 43/14; E21B 43/16
USPC ..... 166/386, 306, 332.4
See application file for complete search history.

(56) References Cited

U.S. PATENT DOCUMENTS

| | | | |
|---|---|---|---|
| 3,011,548 | A | 12/1961 | Holt |
| 3,054,415 | A | 9/1962 | Baker et al. |
| 3,263,752 | A | 8/1966 | Conrad |
| 3,269,463 | A | 8/1966 | Page, Jr. |
| 3,995,692 | A | 12/1976 | Seitz |
| 4,064,937 | A | 12/1977 | Barrington |
| 4,355,686 | A | 10/1982 | Arendt |
| 4,436,152 | A | 3/1984 | Fisher, Jr. et al. |
| 4,729,432 | A | 3/1988 | Helms |
| 4,771,831 | A | 9/1988 | Pringle et al. |
| 5,183,114 | A | 2/1993 | Mashaw, Jr. et al. |
| 5,224,044 | A | 6/1993 | Tamura et al. |

(Continued)

FOREIGN PATENT DOCUMENTS

| | | | |
|---|---|---|---|
| JP | 2003056271 | | 2/2003 |
| JP | 2009270403 | | 11/2009 |
| WO | 03095794 | A1 | 11/2003 |
| WO | 2004088091 | A1 | 10/2004 |

OTHER PUBLICATIONS

Thomson, D. W., and Nazroo, M. F., Design and Installation of a Cost-Effective Completion System for Horizontal Chalk Wells Where Multiple Zones Require Acid Stimulation, SPE 51177 (a revision of SPE 39150), Offshore Technology Conference, May 1997, Houston, TX, USA.

(Continued)

*Primary Examiner* — William P Neuder
(74) *Attorney, Agent, or Firm* — Jeffery R. Peterson; Brandon S. Clark

(57) ABSTRACT

A technique provides a system and methodology for treating a plurality of zones, e.g. well zones. A plurality of flow control devices is located along a tubular structure, such as a well string in a wellbore. Each flow control device or each set of flow control devices comprises a seat member having a unique profile relative to the profiles of the other flow control devices. Drop objects are designed with engagement features arranged to engage the profiles of specific flow control devices. For example, each drop object may have an engagement feature of a corresponding profile designed to engage the unique profile of a specific flow control device or of a specific set of flow control devices to enable actuation of the specific flow control device or the specific set of flow control devices once the drop object is dropped through the tubular structure.

19 Claims, 3 Drawing Sheets

(56) References Cited

U.S. PATENT DOCUMENTS

| | | | |
|---|---|---|---|
| 5,295,393 | A | 3/1994 | Thiercelin |
| 5,305,833 | A | 4/1994 | Collins |
| 5,333,692 | A | 8/1994 | Baugh et al. |
| 5,526,888 | A | 6/1996 | Gazewood |
| 5,921,318 | A | 7/1999 | Ross |
| 5,988,285 | A | 11/1999 | Tucker et al. |
| 6,006,838 | A | 12/1999 | Whiteley et al. |
| 6,059,032 | A | 5/2000 | Jones |
| 6,155,342 | A | 12/2000 | Oneal et al. |
| 6,206,095 | B1 | 3/2001 | Baugh |
| 6,216,785 | B1 | 4/2001 | Achee, Jr. et al. |
| 6,302,199 | B1 | 10/2001 | Hawkins et al. |
| 6,334,486 | B1 | 1/2002 | Carmody et al. |
| 6,371,208 | B1 | 4/2002 | Norman et al. |
| 6,443,228 | B1 | 9/2002 | Aronstam et al. |
| 6,543,538 | B2 | 4/2003 | Tolman et al. |
| 6,634,429 | B2 | 10/2003 | Henderson et al. |
| 6,907,936 | B2 | 6/2005 | Fehr et al. |
| 6,997,263 | B2 | 2/2006 | Campbell et al. |
| 7,066,265 | B2 | 6/2006 | Surjaatmadja |
| 7,093,664 | B2 | 8/2006 | Todd et al. |
| 7,108,067 | B2 | 9/2006 | Themig et al. |
| 7,134,505 | B2 | 11/2006 | Fehr et al. |
| 7,168,494 | B2 | 1/2007 | Starr et al. |
| 7,210,533 | B2 | 5/2007 | Starr et al. |
| 7,322,417 | B2 | 1/2008 | Rytlewski et al. |
| 7,325,617 | B2 | 2/2008 | Murray |
| 7,353,879 | B2 | 4/2008 | Todd et al. |
| 7,377,321 | B2 | 5/2008 | Rytlewski |
| 7,387,165 | B2 | 6/2008 | Lopez de Cardenas et al. |
| 7,431,091 | B2 | 10/2008 | Themig et al. |
| 7,464,764 | B2 | 12/2008 | Xu |
| 7,490,669 | B2 | 2/2009 | Walker et al. |
| 7,522,779 | B2 | 4/2009 | Fu et al. |
| 7,543,634 | B2 | 6/2009 | Fehr et al. |
| 7,543,647 | B2 | 6/2009 | Walker |
| 7,571,765 | B2 | 8/2009 | Themig |
| 7,575,062 | B2 | 8/2009 | East, Jr. |
| 7,661,481 | B2 | 2/2010 | Todd et al. |
| 7,748,460 | B2 | 7/2010 | Themig et al. |
| 7,832,472 | B2 | 11/2010 | Themig |
| 7,891,774 | B2 | 2/2011 | Silverbrook |
| 2003/0180094 | A1 | 9/2003 | Madison |
| 2004/0118564 | A1 | 6/2004 | Themig et al. |
| 2004/0262016 | A1 | 12/2004 | Farquhar |
| 2006/0124310 | A1 | 6/2006 | Lopez de Cardenas et al. |
| 2006/0207764 | A1 | 9/2006 | Rytlewski |
| 2006/0243455 | A1 | 11/2006 | Telfer et al. |
| 2007/0044958 | A1 | 3/2007 | Rytlewski et al. |
| 2007/0107908 | A1 | 5/2007 | Vaidya et al. |
| 2007/0181224 | A1 | 8/2007 | Marya et al. |
| 2007/0272413 | A1 | 11/2007 | Rytlewski et al. |
| 2007/0284097 | A1 | 12/2007 | Swor et al. |
| 2008/0105438 | A1 | 5/2008 | Jordan et al. |
| 2008/0210429 | A1 | 9/2008 | McMillin et al. |
| 2010/0101803 | A1 | 4/2010 | Clayton et al. |
| 2010/0132954 | A1 | 6/2010 | Telfer |
| 2010/0209288 | A1 | 8/2010 | Marya |
| 2010/0282475 | A1 | 11/2010 | Darnell et al. |
| 2011/0056692 | A1 | 3/2011 | Lopez de Cardenas et al. |
| 2011/0127047 | A1 | 6/2011 | Themig et al. |
| 2011/0278010 | A1 | 11/2011 | Fehr et al. |
| 2012/0085538 | A1 | 4/2012 | Guerrero et al. |
| 2013/0081827 | A1* | 4/2013 | Etzel ..... 166/386 |
| 2013/0112435 | A1* | 5/2013 | Fleming et al. ..... 166/386 |
| 2013/0112436 | A1* | 5/2013 | Fleming et al. ..... 166/386 |
| 2013/0118737 | A1* | 5/2013 | Schneider et al. ..... 166/272.3 |

OTHER PUBLICATIONS

Lonnes, S. B., Nygaard, K. J., Sorem, W. A., Hall, T. J., Tolman, R. C., Advanced Multizone Stimulation Technology, SPE 95778, Presented at the 2005 SPE Annual Technical Conference and Exhibition, Oct. 9-12, 2005, Dallas, TX, USA.

Rytlewski, G., Multiple-Layer Commpletions for Efficient Treatment of Multilayer Reservoirs, IADC/SPE 112476, Presented at the 2008 IADC/SPE Drilling Conference, Mar. 4-6, 2008, Orlando, FL, USA.

International Search Report and Written Opinion completed on Apr. 17, 2013 for International Patent Application No. PCT/US2013/020448, filed on Jan. 7, 2013, 11 pages.

* cited by examiner

TREATMENT SYSTEM FOR MULTIPLE ZONES

BACKGROUND

Hydrocarbon fluids are obtained from subterranean geologic formations, referred to as reservoirs, by drilling wells that penetrate the hydrocarbon-bearing formations. In some applications, a well is drilled through multiple well zones and each of those well zones may be treated to facilitate hydrocarbon fluid productivity. For example, a multizone vertical well or horizontal well may be completed and stimulated at multiple injection points along the well completion to enable commercial productivity. The treatment of multiple zones can be achieved by sequentially setting bridge plugs through multiple well interventions. In other applications, drop members, e.g. drop balls, are used to open sliding sleeves at sequential well zones with size-graduated drop balls designed to engage seats of progressively increasing diameter.

SUMMARY

In general, the present disclosure provides a system and method for treating a plurality of zones, e.g. well zones. A plurality of flow control devices is located along a tubular structure, such as a well string in a wellbore. Each flow control device or each set of flow control devices comprises a seat member with a unique profile relative to the profiles of the other flow control devices. Drop objects are designed with engagement features arranged to engage the unique profiles of specific flow control devices. For example, each drop object may have an engagement feature of a corresponding profile designed to engage the unique profile of a specific flow control device or of a specific set of flow control devices to enable actuation of the desired flow control device or devices once the drop object is dropped or otherwise moved through the tubular structure.

BRIEF DESCRIPTION OF THE DRAWINGS

Certain embodiments will hereafter be described with reference to the accompanying drawings, wherein like reference numerals denote like elements. It should be understood, however, that the accompanying figures illustrate only the various implementations described herein and are not meant to limit the scope of various technologies described herein, and.

DETAILED DESCRIPTION

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology which facilitate multi-zonal treatments along a tubular structure. For example, the system and methodology may be used to facilitate the treatment of a plurality of well zones located along a wellbore drilled through a subterranean formation. Depending on the application, the wellbore may be vertical and/or deviated, e.g. horizontal, and may extend through multiple well zones. The individual well zones can be subjected to a variety of well treatments to facilitate production of desired hydrocarbon fluids, such as oil and/or gas. The well treatments may comprise stimulation treatments, such as fracturing treatments, performed at the individual well zones. However, a variety of other well treatments may be employed utilizing various types of treatment materials, including fracturing fluid, proppant materials, slurries, acidizing materials, chemicals, and other treatment materials designed to enhance the productivity of the well.

Also, the well treatments may be performed in conjunction with many types of well equipment deployed downhole into the wellbore. For example, various completions may employ a variety of flow control devices which are used to control the lateral flow of fluid out of and/or into the completion at the various well zones. In some applications, the flow control devices are mounted along a well casing to control the flow of fluid between an interior and exterior of the well casing. For example, the flow control devices may be used to create a controllable fluid type barrier for diverting stimulation fluid into an adjacent formation. Flow control devices also may be positioned along internal tubing or along other types of strings/tubing structures deployed in well related and non-well related applications. The flow control devices may comprise sliding sleeves, valves, and other types of flow control devices actuated by a drop object moved down through the tubular structure.

Figure 1:
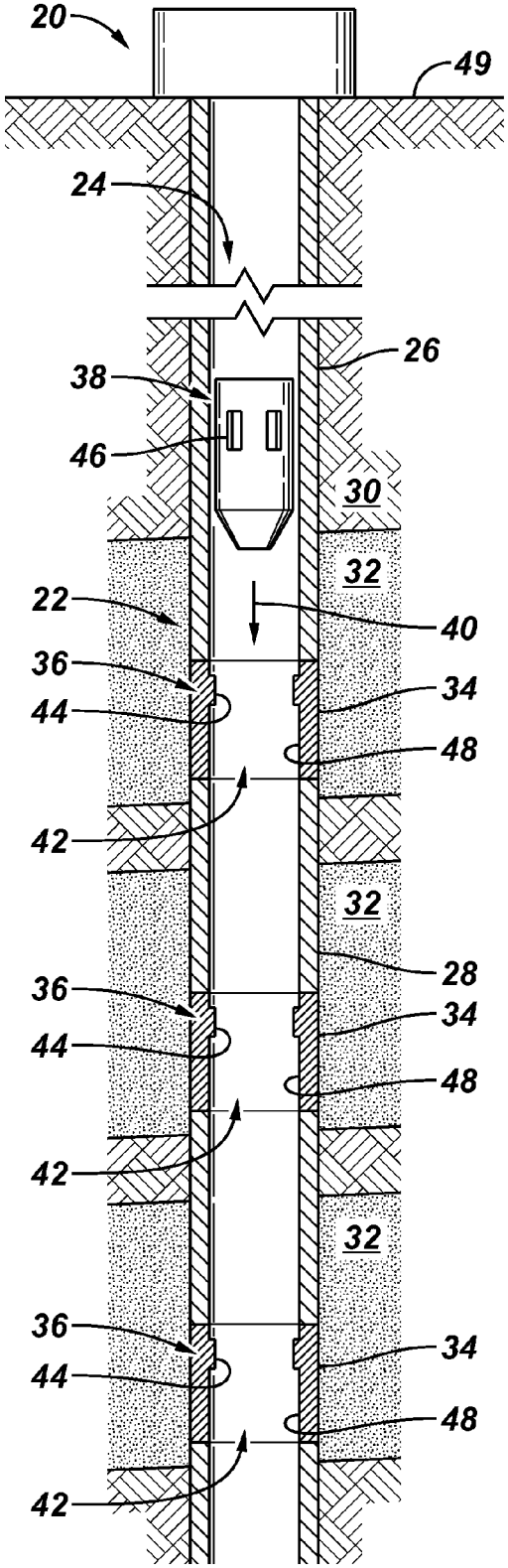
FIG. 1 is a schematic illustration of an example of a well system comprising a plurality of flow control devices that may be selectively actuated, according to an embodiment of the disclosure.

Referring generally to FIG. 1, an example of one type of application utilizing a plurality of flow control devices is illustrated. The example is provided to facilitate explanation, and it should be understood that a variety of well completion systems and other well or non-well related systems may utilize the methodology described herein. The flow control devices may be located at a variety of positions and in varying numbers along the tubular structure depending on the number of external zones to be treated.

In FIG. 1, an embodiment of a well system 20 is illustrated as comprising downhole equipment 22, e.g. a well completion, deployed in a wellbore 24. The downhole equipment 22 may be part of a tubing string or tubular structure 26, such as well casing, although the tubular structure 26 also may comprise many other types of well strings, tubing and/or tubular devices. Additionally, downhole equipment 22 may include a variety of components, depending in part on the specific application, geological characteristics, and well type. In the example illustrated, the wellbore 24 is substantially vertical and tubular structure 26 comprises a casing 28. However, various well completions and other embodiments of downhole equipment 22 may be used in a well system having other types of wellbores, including deviated, e.g. horizontal, single bore, multilateral, cased, and uncased (open bore) wellbores.

In the example illustrated, wellbore 24 extends down through a subterranean formation 30 having a plurality of well zones 32. The downhole equipment 22 comprises a plurality of flow control devices 34 associated with the plurality of well zones 32. For example, an individual flow control device 34 may control flow from tubular structure 26 into the surrounding well zone 32 or vice versa. The flow control devices 34 may be employed as controllable fluid type barriers for diverting stimulation fluid into adjacent formations. In some applications, a plurality of flow control devices 34 may be associated with each well zone 32. By way of example, the illustrated flow control devices 34 comprise sliding sleeves, although other types of valves and devices may be employed to control the lateral fluid flow. The flow control devices 34 may be used in many downhole applications, including applications implemented in cemented boreholes or uncemented boreholes. The flow control devices 34 also may be positioned to cooperate with openings in casing or other types of tubing.

As illustrated, each flow control device 34 comprises a seat member 36 designed to engage a drop object 38, e.g. a dart or ball, which is dropped down or otherwise moved through tubular structure 26 in the direction illustrated by arrow 40. Each drop object 38 moved downhole is associated with at least one specific seat member 36 of at least one specific flow control device 34 to enable actuation of that specific flow control device or devices 34. However, engagement of the drop object 38 with the specific, corresponding seat member 36 is not necessarily dependent on matching the diameter of the seat member 36 with a diameter of the drop object 38. In the embodiment of FIG. 1, for example, the plurality of flow control devices 34 may be formed with longitudinal flow through passages 42 having diameters which are of common size. This enables maintenance of a relatively large flow passage through the tubular structure 26 across the multiple well zones 32. Depending on the specific application, drop objects 38 may be constructed in a variety of shapes and configurations. For example, each drop object 38 may be elongated, e.g. cylindrical; spherical, e.g. ball-shaped; or another suitable shape and configuration.

In some applications, a specific drop object 38 may be designed to cooperate with a set of seat members 36 associated with a set of flow control devices 34 selected out of the total number of flow control devices. For example, one drop object 38 can be used to open multiple flow control devices 34, e.g. multiple sleeves, as it is pumped down before ultimately landing in the final seat member of the set of seat members 36. A subsequent drop object 38 having a different profile can then be used to open a subsequent flow control device 34 or a subsequent set of flow control devices 34. In this manner, the drop objects 38 would have a reduced number of unique profiles relative to the flow control devices 34 actuated by those drop objects. In such an application, the seat members 36 of each set of flow control devices 34 can be designed to move out of the way when sufficient pump down pressure is applied to the drop object 38. For example, the seat members 36 can be designed to move into a recess in the tubing, e.g. casing, to allow the drop object 38 to move to the next seat member 36 of the set before ultimately landing in the final seat member 36 of the set of flow control devices 34. Each subsequent, uniquely profiled drop object 38 is then used to actuate the subsequent set of flow control devices 34.

In the example illustrated, each seat member 36 (or each seat member 36 of a specific set of seat members 36) comprises a unique profile 44, such as a unique, cross-sectional profile, which is designed to engage a corresponding engagement feature 46 of the drop object 38. By way of example, each unique profile 44 may be designed with a series of circumferential extensions or protuberances separated by spaces arranged in a pattern to correspond with and seat against engagement feature 46 of the specific corresponding drop object 38. The drop object 38 corresponding to a specific unique profile 44 has its engagement feature 46 designed with an object profile that corresponds to and seats against the specific unique profile 44. In some embodiments, the unique profile 44 is formed in a sidewall 48 of seat member 36, and the sidewall 48 also may serve to create the longitudinal flow through passage 42 through each flow control device 34. The unique profile 44 and the corresponding profile of the drop object 38 also may be designed as a lock and key arrangement in which specific drop objects 38 have a series of ridges selected to match a corresponding pattern of recesses in corresponding seat members. This type of lock and key configuration can be used to match specific drop objects 38 with specific seat members 36 and their corresponding flow control devices 34.

The flow control devices 34 can be arranged such that the seat member 36 of the distal flow control device 34, e.g. the bottom flow control device, in wellbore 24 has the unique profile 44 positioned to match a specific, e.g. first, corresponding drop object 38. The specific corresponding drop object 38 is able to pass through all of the initial flow control devices 34 until seating against the corresponding unique profile 44 in seat member 36 of the distal flow control device 34. Each successive flow control device 34 (moving in a direction along wellbore 24 toward a surface location 49) has a seat member with a unique profile 44 designed to engage the next corresponding drop object 38 after passing through any previous flow control devices 34. Consequently, a series of sequential drop objects 38 is dropped or otherwise moved along the wellbore 24 to engage each next sequential matching unique profile 44 of each sequential flow control device 34. For example, the first drop object 38 has the engagement feature 46 matching the unique profile 44 of the most distal flow control device 34 to enable treatment of the most distal well zone 32. Each sequentially deployed drop object 38 has a different engagement feature 46 matching the unique profile 44 of each sequential seat member 36 to enable sequential treating of the well zones 32 in a pattern moving from a distal well region to a region closer to surface location 49. As described above, however, some applications may use a drop object 38 with a specific profile to actuate a set of flow control devices 34 instead of individual flow control devices. For example, a first drop object 38 can be pumped downhole to open the lowermost set of flow control devices 34. A subsequent drop object 38 can be pumped downhole to open the subsequent set of flow control devices 34, and this process may be repeated for each subsequent flow control device or set of flow control devices 34.

Figure 2:
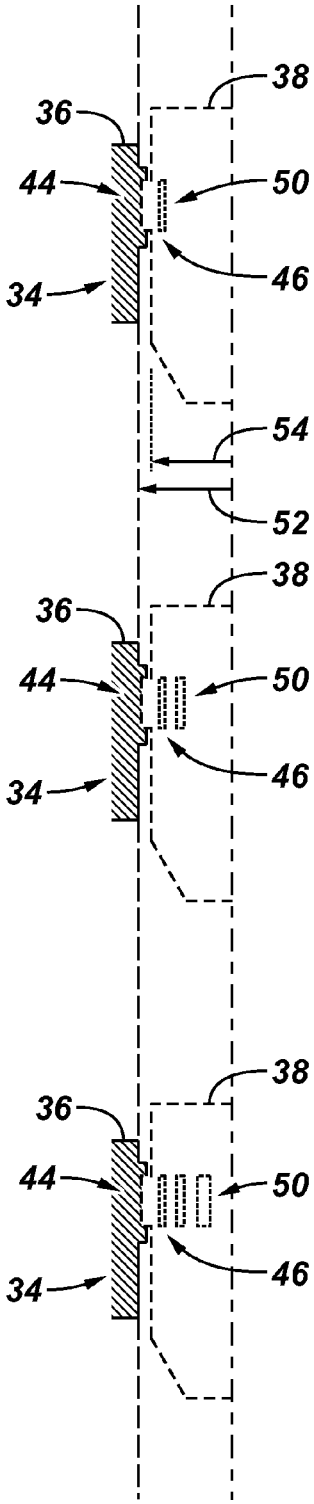
FIG. 2 is a schematic illustration of flow control devices having seat members with unique profiles for interaction with corresponding engagement features of drop objects, according to an embodiment of the disclosure.

Referring generally to FIG. 2, a schematic example of a system and methodology for treating multiple well zones is illustrated. In this example, each flow control device 34 is actuated by movement of the seat member 36 once engaged by a corresponding drop object 38. Each seat member 36 comprises unique profile 44 in the form of a unique, cross-sectional profile. However, a width, e.g. diameter, 52 of each seat member flow through passage 42 may be the same from one seat member 36 to the next. This enables construction of drop objects 38 having a common cross-sectional width, e.g. diameter, 54 to facilitate movement down through tubular structure 26. However, each sequentially released, e.g. dropped, object 38 has its engagement feature 46 in the form of a corresponding profile 50. Each corresponding profile 50 is unique relative to the corresponding profile of the previously released drop object 38, and the corresponding profile is selected to match the unique profile 44 of the next sequential flow control device 34. In some applications, the plurality of seat members 36 may be divided into groups or sets of seat members 36 in which the seat members 36 of each set have a common diameter that differs from the common diameter of other sets of seat members 36. This type of application enables, for example, the use of graduated diameter seat members 36 and corresponding graduated diameter drop objects 38 while still reducing the overall number of diameter gradations due to use of common diameters within each set of seat members 36.

In a multizone treatment operation, the first drop object 38 is selected with engagement feature 46 matching the unique profile 44 of the flow control device 34 located farthest downhole. Due to the design of the engagement feature 46, the first dart 38 passes down through the flow control devices 34 until the engagement feature 46 engages with and seats against the lowermost seat member 36 illustrated in the example of FIG. 2. Pressure may then be applied through the tubular structure 26 and against the first drop member 38 to transition the seat member 36 and the corresponding flow control device 34 to a desired operational configuration. For example, the flow control device 34 may comprise a sliding sleeve which is transitioned to an open flow position to enable outward flow of a fracturing treatment or other type of treatment into the surrounding well zone 32.

Once the initial well zone is treated, a subsequent drop object 38 is dropped or otherwise moved down through the flow through passages 42 of the upper flow control device or devices 34 until the engagement feature 46 is able to engage with and seat against the unique profile 44 of the next sequential seat member 36 relative to the lowermost seat member. Pressure may then again be applied down through the tubular structure 46 to transition the flow control device 34 to a desired operational configuration which enables application of a desired treatment at the surrounding well zone 32. A third drop object 38 may then be moved downhole for engagement with the seat member 36 of the third flow control device 34 to enable actuation of the third flow control device and treatment of the surrounding well zone. This process may be repeated as desired for each additional flow control device 34 and well zone 32. Depending on the application, a relatively large number of drop objects 38 is easily deployed to enable actuation of specific flow control devices along the wellbore 24 for the efficient treatment of multiple well zones. As described above, however, the system also may be designed so that individual drop objects 38 engage and actuate a set of flow control devices so that multiple entry points may be activated with the same drop object 38.

Figure 3:
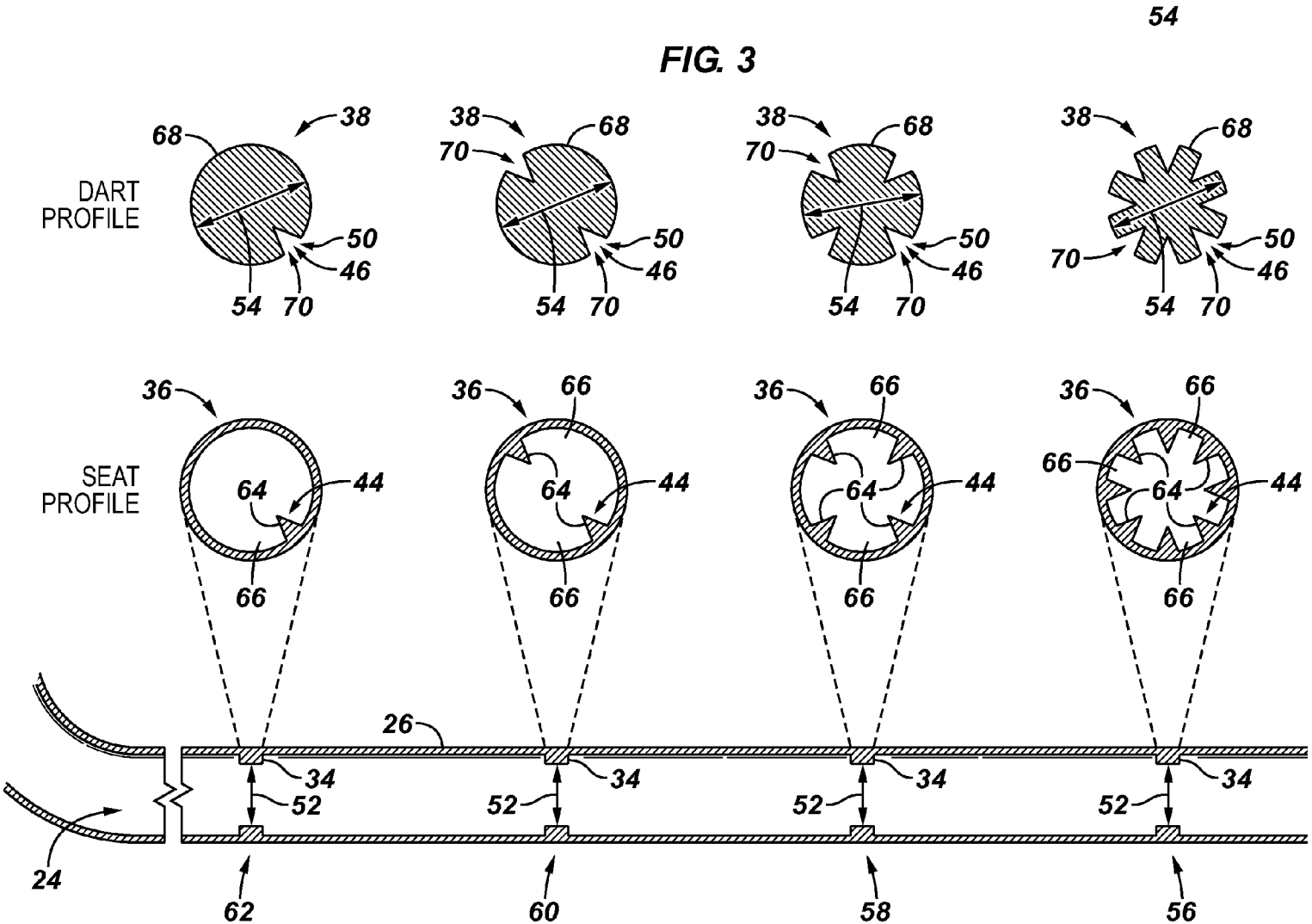
FIG. 3 is a diagram illustrating a wellbore with a plurality of devices that may be actuated via seat members having unique profiles designed to match corresponding drop object profiles of specific drop objects selected from a plurality of drop objects, according to an embodiment of the disclosure.

The actual design of the unique profile 44 and of the engagement feature 46 may vary from one application to another. In FIG. 3, for example, an embodiment of the unique profiles 44 and corresponding object profiles 50 is illustrated with respect to a plurality of corresponding locations along wellbore 24. In this example, each unique profile 44 is in the form of a unique, cross-sectional profile associated with a specific seat member 36 of a specific flow control device 34 for controlling flow of stimulation fluid or other treatment fluid during a stimulation operation along the wellbore 24. For example, four unique profiles 44 may be associated with four flow control devices 34 (or four sets of flow control devices 34) positioned at unique locations along wellbore 24, e.g. unique locations 56, 58, 60 and 62. In the example illustrated, the four unique locations 56, 58, 60 and 62 are located along a deviated, e.g. horizontal, section of wellbore 24. However, the flow control devices 34 may be located along deviated sections and/or vertical sections of the wellbore 24. Additionally, four flow control devices 34 are illustrated for purposes of explanation and a lesser number or greater number of flow control devices 34 may be employed for a given operation.

Each unique, cross-sectional profile 44 comprises a specific number of radially inward extensions 64 separated circumferentially by spaces 66. The corresponding profile 50 of each drop object 38 comprises a number of radially outward extensions 68 separated by gaps or spaces 70. The gaps or spaces 70 are designed to matingly engage the seat member 36 having an appropriate number and arrangement of radially inward extensions 64 to block further progression of the drop object 38. The size, pattern, and/or arrangement of radially inward extensions 64 is selected so as to cooperate with the corresponding drop object 38 such that the drop object 38 seats in the corresponding seat member 36 to enable actuation of the flow control device 34. If the number of radially inward extensions 64 is less than the gaps 70 of the drop object 38 delivered downhole, the drop member 38 simply passes through the seat members 36 until seating against the appropriate corresponding unique profile 44 of the specific flow control device or devices 34 intended. However, the drop object cross-sectional width 54 may be the same for each drop object 38 and the seat member width 52 may be the same for each seat member 36. This uniform sizing may be used in at least some embodiments to provide a consistent flow through passage 42 at each flow control device 34 rather than employing passages with graduated diameters. As described above, however, other embodiments may utilize sets of seat members 36 in which the seat member width 52 is common within a given set but different from the seat member widths 52 of other sets of seat members 36.

Figure 4:
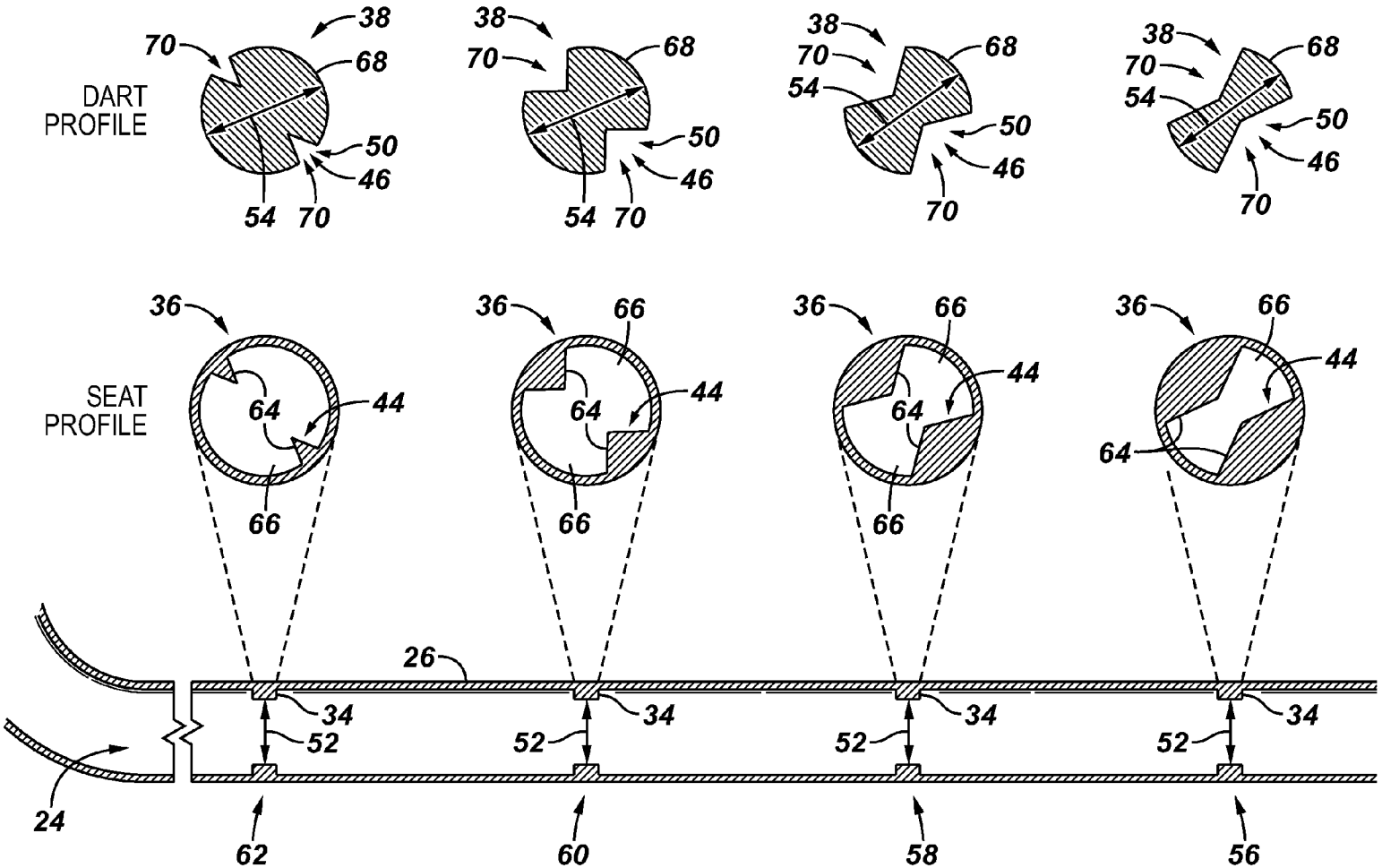
FIG. 4 is a diagram illustrating another example of a wellbore with a plurality of devices that may be actuated via seat members having unique profiles designed to match corresponding drop objects profiles select drop objects from a plurality of drop objects, according to an embodiment of the disclosure.

The specific configuration of the unique profile 44 and of the corresponding profile 50 may be different for different applications while maintaining the function of drop objects 38 passing through seat members 36 until matingly engaging the unique profile 44 of the intended flow control device 34. As illustrated in FIG. 4, for example, another design for both the unique profile 44 and the corresponding profile 50 is illustrated. In this example, the number of radially inward extensions 64 and the number of radially outward extensions 68 are the same for each seat member 36 and drop object 38, respectively. However, the size and/or configuration of each radially inward extension 64 and each radially outward extension 68 is selected such that each dart 38 passes through seat members 36 until engaging and seating against the intended corresponding unique profile 44.

In many multizone well treatment applications, the first drop object 38 selected passes through all of the seat members 36 and corresponding flow control devices 34 until engaging and seating against the unique profile 44 of the distal flow control device 34 positioned at a distal location. The next drop object 38 delivered downhole passes through seat members 36 until engaging and seating against the unique profile 44 of the next sequential flow control device 34 positioned at, for example, location 56 or 58. The third dart 38 delivered downhole passes through the initial seat member 36 until engaging and seating against the unique profile 44 of the next sequential flow control device 34 positioned at, for example, location 60. The final drop object 38 delivered downhole engages the initial seat member 36 positioned at the first location 62. Once each drop object 38 is seated at the appropriate corresponding unique profile 44, pressure applied through the tubular structure 26 may be used to actuate the corresponding flow control device 34. In multizone, well treatment applications, actuation of each individual flow control device 34 enables treatment of the surrounding well zone prior to moving the next sequential drop object 38 downhole.

It should be noted that drop object 38 may be constructed in a variety of configurations which may include generally cylindrical configurations, spherical configurations, or other configurations which allow the corresponding profile 50 of its engagement feature 46 to seat against the unique corresponding profile 44. The engagement feature 46 and corresponding profile 44 also may be constructed in a lock and key configuration, as described above. Use of unique profiles 44 enables construction of drop objects 38 having common diameters for movement through all passages 42 or sets of passages 42 having common diameters until the drop object 38 reaches the specific, corresponding flow control device 34. In some applications, the drop object 38 can be designed to seal against a corresponding seal member formed of a hard rubber or other suitable material and mounted directly in a casing sub.

The drop objects 38 also may be formed from a variety of materials. In many applications, the darts are not subjected to abrasive flow, so the drop objects 38 may be constructed from a relatively soft material, such as aluminum. In a variety of applications, the drop objects 38 also may be formed from degradable, e.g. dissolvable, materials which simply degrade over a relatively short period of time following performance of the well treatment operation at the surrounding well zone 32. Upon sufficient degradation, the drop object 38 can simply drop through the corresponding flow control device 34 to allow production fluid flow, or other fluid flows, along the interior of the tubular structure 26. In some applications, the seat members 36 are formed of degradable materials, e.g. dissolvable materials, which can be degraded to enable passage of the drop object 38. Depending on the application, the drop object 38, the seat member 36, or both the drop object 38 and the seat member 36 can be constructed from degradable materials. The specific degradable material selected may depend on the parameters of a given application and/or environment. However, examples of degradable materials suitable for use in forming drop objects 38 and/or seat members 36 may be found in US Patent Application Publication Nos.: 2010/0209288; US 2007/0181224; 2007/0107908; and 2007/0044958.

Depending on the application, each drop object 38 may be formed with an internal flow passage and check valve oriented to enable pressure buildup directed in a downhole direction and to allow flow back in an uphole direction. The check valve may be formed with a ball, plug, or other device designed to seal against a corresponding seat. The ball, plug or other suitable device also may be formed of a degradable material which dissolves or otherwise degrades over a suitable length of time to allow a production flow. In such an application, the internal seat and the flow passage within the drop object 38 are designed with sufficient diameter to accommodate a suitable production flow without needing to remove the remaining portion of the drop object 38, e.g. the dart housing. In place of a check valve, a center portion of the drop object 38 also can be formed of a degradable material that degrades over a certain period of time to expose a flow through passage able to accommodate production flow.

Furthermore, the system and methodology may be employed in non-well related applications which require actuation of devices at specific zones along a tubular structure. Similarly, the system and methodology may be employed in many types of well treatment applications and other applications in which devices are actuated downhole via dropped darts or other types of drop objects without requiring any changes to the diameter of the internal fluid flow passage. Different well treatment operations may be performed at different well zones without requiring separate intervention operations. Sequential drop objects may simply be dropped or otherwise moved into engagement with specific well devices for actuation of those specific well devices at predetermined locations along the well equipment positioned downhole.

Although only a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method of treating a plurality of well zones, comprising:

locating a plurality of flow control devices along a well string in a wellbore;

providing each flow control device with a seat member having a unique cross-sectional profile relative to the cross-sectional profiles of at least some of the other flow control devices;

releasing into the well string a drop object having an engagement feature with a corresponding object profile selected to engage the unique cross-sectional profile of the seat member in a specific flow control device of the plurality of flow control devices, each flow control device being structured to create a fluid tight barrier which may be controlled for diverting stimulation fluid into an adjacent formation; and forming each unique cross-sectional profile with radially inward extensions separated circumferentially by spaces.

2. The method as recited in claim 1, wherein locating comprises locating a plurality of sliding sleeves along a well completion.

3. The method as recited in claim 1, wherein releasing comprises releasing a plurality of drop objects for engagement with the unique cross-sectional profiles of the plurality of flow control devices, each drop object having a unique object profile relative to the other drop objects.

4. The method as recited in claim 1, further comprising forming each corresponding object profile with unique radially outward extensions separated by gaps so as to allow the drop object to pass through seat members until engaging a specific corresponding seat member of the specific flow control device.

5. The method as recited in claim 4, further comprising releasing a second drop object with a different number of unique gaps relative to the first drop object to engage the next sequential seat member.

6. The method as recited in claim 1, further comprising applying pressure through the well string after the engagement feature engages the unique cross-sectional profile of a desired flow control device to actuate the desired flow control device to an open flow position.

7. The method as recited in claim 6, further comprising stimulating a surrounding well zone after actuating the desired flow control device.

8. The method as recited in claim 1, wherein locating comprises locating the flow control devices along a tubular of a well completion.

9. The method as recited in claim 1, wherein locating comprises locating the flow control devices along a casing in the wellbore.

10. A system for use in a well, comprising:

a plurality of flow control devices positioned along a tubing to control flow between an interior and an exterior of the tubing, each flow control device having a seat member with a sidewall forming a longitudinal flow through passage and a unique cross-sectional profile relative to the cross-sectional profiles of other seat members; and a plurality of drop objects, each drop object comprising an engagement feature with a corresponding profile arranged to engage the unique cross-sectional profile of a specific seat member.

11. The system as recited in claim 10, wherein the plurality of flow control devices comprises a plurality of sliding sleeves.

12. The system as recited in claim 10, wherein the tubing comprises a well casing.

13. The system as recited in claim 10, wherein the engagement feature of each drop object comprises a unique number of gaps arranged along a circumference of the drop object.

14. The system as recited in claim 10, wherein the longitudinal flow through passage of each seat member has the same diameter as the longitudinal flow through passages of other seat members in a set of seat members.

15. A method, comprising:

providing a multizone well stimulation system with a plurality of flow control devices actuated via drop objects which are dropped to engage seat members of the plurality of flow control devices; and forming at least some of the seat members with flow through passages of common diameter and with unique cross-sectional profiles corresponding with specific flow control devices.

16. The method as recited in claim 15, further comprising selecting a plurality of drop objects, each drop object having an engagement feature with a corresponding profile arranged to engage the unique cross-sectional profile of a specific flow control device.

17. The method as recited in claim 16, further comprising releasing a first drop object of the plurality of drop objects through at least one flow through passage and into engagement with the seat member having the unique cross-sectional profile corresponding with the engagement feature of the first drop object.

18. The method as recited in claim 17, further comprising applying pressure to shift the flow control device engaged by the first drop object and performing a well treatment of a surrounding well zone.

19. The method as recited in claim 18, further comprising releasing a second drop object of the plurality of drop objects through at least one flow through passage and into engagement with the seat member having the unique cross-sectional profile corresponding with the engagement feature of the second drop object.

* * * * *